US005184351A

United States Patent [19]

Benstock

[11] Patent Number: 5,184,351

[45] Date of Patent: Feb. 9, 1993

[54] VERSATILE PATIENT GOWN

[75] Inventor: Gerald M. Benstock, Bellair Beach, Fla.

[73] Assignee: Superior Surgical Mfg. Co., Inc., Seminole, Fla.

[21] Appl. No.: 652,102

[22] Filed: Feb. 7, 1991

Related U.S. Application Data

[63] Continuation-in-part of Ser. No. 562,144, Aug. 2, 1990.

[51] Int. Cl.[5] ..... A41D 13/00

[52] U.S. Cl. ..... 2/114; 2/105; 2/DIG. 7

[58] Field of Search ..... 2/46, 69, 104, 105, 2/106, 114, 115, 243 B, 243 R, DIG. 4, DIG. 6, DIG. 7

[56] References Cited

U.S. PATENT DOCUMENTS

| | | | |
|---|---|---|---|
| 1,462,515 | 7/1923 | McEuroy | 2/DIG. 7 X |
| 2,701,364 | 2/1955 | Palm | 2/114 |
| 3,490,072 | 1/1970 | Keltner | 2/114 |
| 3,492,673 | 2/1970 | Zamist | 2/243 R |
| 3,748,659 | 7/1973 | Meyers | 2/114 X |
| 4,570,268 | 2/1986 | Freeman | 2/DIG. 7 X |
| 4,582,508 | 4/1986 | Pavelka | 2/DIG. 7 X |
| 4,612,673 | 9/1986 | Underhill | 2/DIG. 7 X |
| 4,683,594 | 8/1987 | Feinberg | 2/105 |
| 4,698,848 | 10/1987 | Buckley | 2/114 |
| 4,718,124 | 1/1988 | Sawicki et al. | 2/DIG. 7 X |
| 4,737,995 | 4/1988 | Wiley | 2/DIG. 7 |
| 5,062,159 | 11/1991 | Jakub | 2/105 |

*Primary Examiner*—Werner H. Schroeder
*Assistant Examiner*—Jeanette E. Chapman

[57] ABSTRACT

The versatile patient gown of the present invention provides access to the entire torso, front or back without removing the gown by opening the releasable butterfly sleeve closures and cotton ties. The gown has multiple uses as a regular patient gown, a surgical gown; it can be used in intensive care by opening a sleeve for I.V.'s, etc.; for critical care using a telemeter unit placeable in a front pocket which has a buttonhole to pass the lead into the body; for radiology by using exclusively VELCRO closures and cotton ties; for mammography and for neonatal care by exposing the breast or chest without removing the entire gown.

8 Claims, 6 Drawing Sheets

VERSATILE PATIENT GOWN

CROSS-REFERENCE TO RELATED APPLICATIONS

This is a continuation-in-part of my application Ser. No. 07/562,144, filed Aug. 2, 1990, commonly assigned.

BACKGROUND OF THE INVENTION

The present invention relates to a VERSATILE PATIENT GOWN designed to provide access to the entire torso, front or back, without removing the gown, by opening the releasable butterfly sleeve closures, and cotton ties at the back of the waist and the neck. This garment has six different uses each of which would normally require separate garments for each use. The uses are: (1) as a regular patient gown; (2) for use in intensive care, because the sleeve can be opened for I.V.s, etc.; (3) for use in critical care because it has a front pocket to be used for carrying a telemeter unit, a buttonhole within said pocket to pass the lead from the telemeter unit into an invasive line within the body (such as A-lines or deep venus lines), the pocket supports the telemeter unit (which has external cabling to go to a recorder in a display mode); (4) in radiology (because there are no metallic closures on the gown) as it is supplied with VELCRO closures at the shoulder areas to create sleeve closures, and at the back of the neck closure, and cotton ties to secure the waist at the back of the torso; (5) in mammography because it allows exposure of either breast or chest without removing the entire gown by opening the top portions while still securing the gown around the waist; (6) in neonatal care because it allows the new mother to nurse the child conveniently because of easy opening and closing of the gown, with reduced exposure by only opening one shoulder.

PRIOR ART

The prior art does not disclose a patient gown having the above multiple uses.

U.S. Pat. No. 4,258,440 to McGowan, discloses a garment for dressing physically handicapped persons comprising a front panel and a rear panel having fastening means on the opposed side edge margins of each panel, which is also provided with two loops on each opposed side edge margins to facilitate dressing oneself. There is no disclosure of a garment which is provided with openings in the butterfly sleeves having releasable VELCRO closures and cotton ties and a front pocket with an inner buttonhole, as in the present invention.

U.S. Pat. No. 4,296,497 to Herman, discloses a hospital patient gown comprising a front panel joined to two rear panels having a vertical opening at the back. One rear panel is vertically pleated with a reverse pleat and draped across the rear opening and the rear panels are fastened together at the top of the gown by means of inner snaps. There is no disclosure of openings in the front panels or sleeves to allow access to the front torso for mammography testing, neonatal care, radiology or surgical purposes as in the present garment. There are no disclosures of a pocket on the front of the gown, or releasable butterfly sleeve closures and cotton ties, as in the present garment.

U.S. Pat. No. 4,674,130 to Coudron, discloses a childrens' sleeping bag shaped to cover a part of the body having openings for the head, arms and feet, comprising a front and rear rectangular panel provided with releasable adhering means on the opening sides of the front and rear panels. This patent does not disclose the features of the present invention, namely the releasable butterfly sleeve closures and cotton ties, and a front pocket with an inner buttonhole.

U.S. Pat. No. 4,737,995 to Wiley, discloses a child's two-piece hospital uniform comprising a gown with a V-neck formed with seven panels, a bib front panel provided with patch pockets, raglan sleeves having a shoulder seam formed with two VELCRO strips disposed along the top edge of said sleeve, and two half rear sections, each having an inner vertical edge provided with two spaced ties to close the back of the gown. There is no disclosure of butterfly sleeves or a buttonhole on the front panel behind the front pocket or an overlap of the rear panels provided with VELCRO closures.

U.S. Pat. No. 4,759,083 to Belcher, discloses a surgical and examination gown comprising a combination of multiple garment pieces and panels, a back panel, a front panel, a back yoke resting on the back shoulder, and front yoke resting on the upper chest area, a right shoulder segment connected to said back yoke and front yoke, and a left shoulder segment connected to said back yoke and front yoke. Said garment panels and parts are provided with releasable closures such as VELCRO, to enable selective and separate access to particular parts of the body for examination or treatment. The present novel patient gown does not use multiple panels and garment pieces as in this patent. Furthermore, this patent does not disclose butterfly sleeves, a front pocket and a buttonhole in the front panel behind the pocket. The only similarity between this patent and present invention is in the use of VELCRO as releasable closures.

U.S. Pat. No. 4,764,986 to Stewart, discloses a waterproof garment for a patient with a thoracic incision, constructed so that the patient can put on or take off said garment without raising his arms. The garment is in the form of a jacket which is completely opened on one side of the garment, which extends through one sleeve provided with VELCRO fasteners along the main side opening, the opening sleeve and the neck area. The VELCRO releasable closures of Stuart is the sole feature in common with the garment of this application.

U.S. Pat. No. 4,920,578 to Janzen et al., discloses a patient's gown that allows partial or complete exposure of a patient's chest, comprising a yoke around the neck opening secured to a rear panel, a front panel with side edges that extend downwardly to the subclavian area and two-sleeve panels. The front panel side edges are releasably connected to the front edges of the sleeve panels via releasable snaps, so that the bodice can be dropped partially or fully on one or both sides. There is no disclosure of openings in the butterfly sleeves provided with releasable VELCRO closures and a front panel pocket with an inner buttonhole used in the present invention.

U.S. Pat. No. 4,930,161 to Cohen, discloses a garment for medical examination and treatment comprising a trunk with front and rear portions and a waist region, said rear portion having a rear opening extending between the crotch and the waist, a rear closure means for covering a portion of the rear opening which comprises a foldable flap about a fold line parallel and spaced from the center line.

The prior art does not disclose a garment made from one major piece of fabric, or from three separate panels, a front panel and two identical rear panels, each panel having a free edge to provide a longitudinal rear opening, having multiple uses, comprising butterfly sleeves with VELCRO closures and cotton ties, a pocket offset to the right side on the front of the gown to carry telemetry devices and the like, a buttonhole inside the pocket for invasive monitoring of the patient and VELCRO closures at the top of the gown, this being free of metal closures and pins.

SUMMARY

The garment of the present invention is designed to provide access to the entire torso, front or back, removal, by opening a releasable butterfly sleeve closures and/or the rear neck and waist cotton ties for partial or complete exposure of the part of the body to be treated or examined. The gown has multiple uses which would normally require different garments for each use.

Accordingly, the primary object of the present invention is to provide a patient gown which enables selective and separate access to specific parts of the patient's body, without removing the entire gown.

Another object of the present invention is to provide a single gown which has multiple uses.

Still another object of the present invention is to provide a one-piece gown that can be fully opened to expose all surfaces for cleaning and easy repair.

The present novel garment is a one-piece gown that can be fully opened comprising a body with a neck opening and a back opening provided with cotton ties at the waist to close the back of the gown, two butterfly sleeves formed and provided with releasable VELCRO closures situated on the top open edges of each butterfly sleeve adjacent to the neck opening, the back of the neck opening being provided with cotton ties to close the gown, which a front pocket and an inside buttonhole offset to the right side to avoid the sternum.

DETAILED DESCRIPTION

Figure 1:
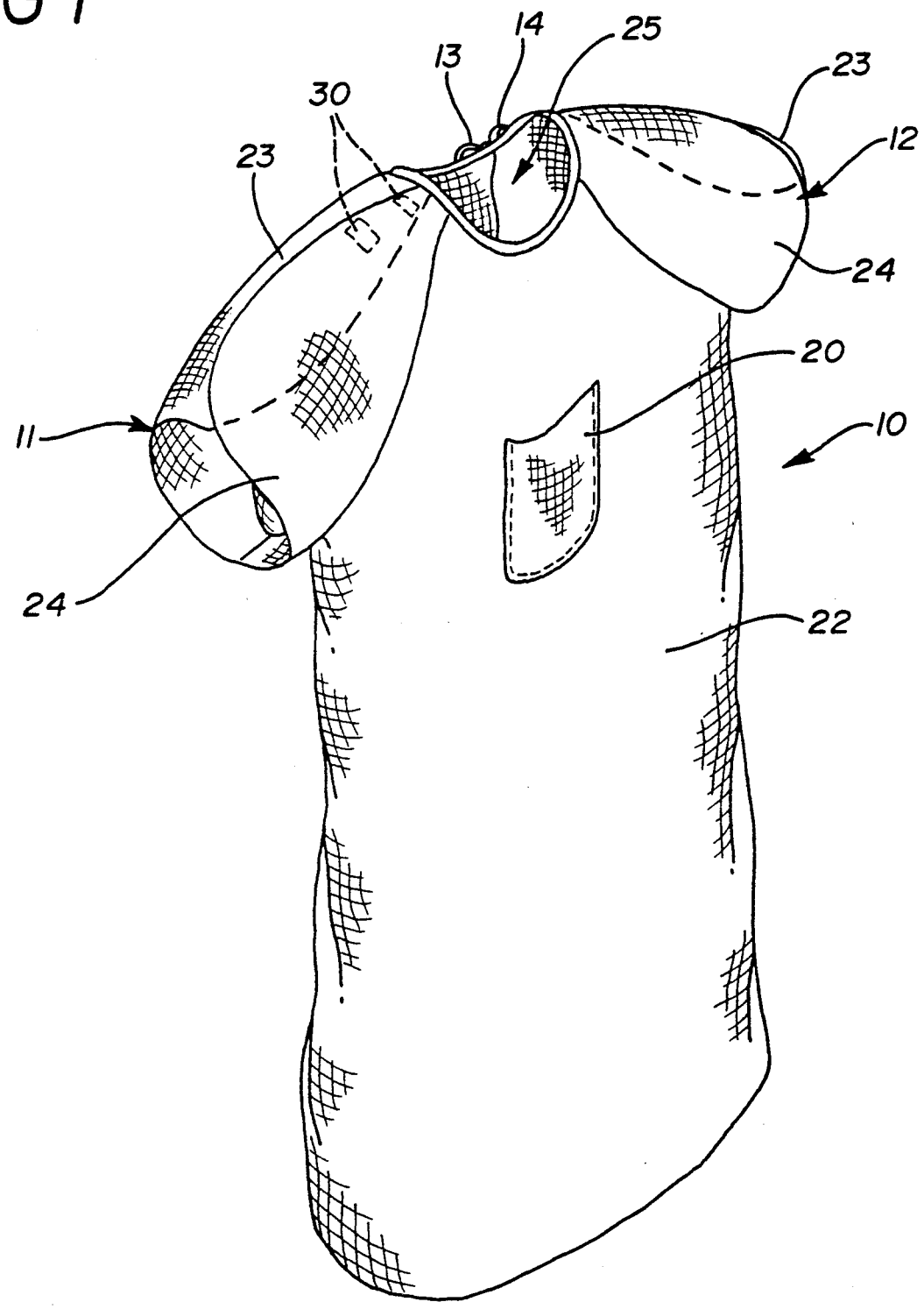
FIG. 1 is a perspective view from the front upper left of the VERSATILE PATIENT GOWN incorporating a minuet and unique design with the gown shown in the fastened condition so as to appear as it would when worn by a patient.
Figure 2:
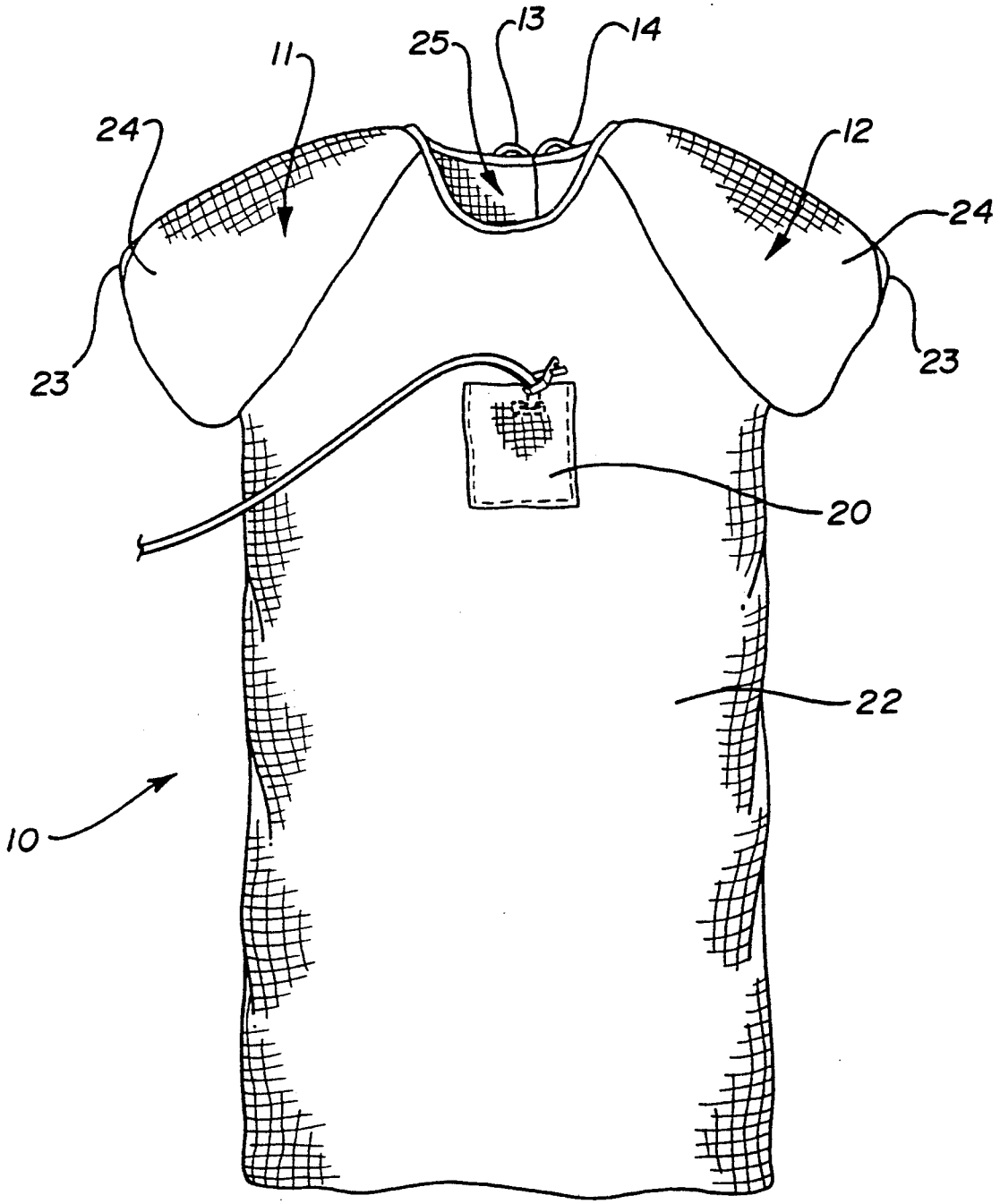
FIG. 2 is a front elevational view of the gown as shown in FIG. 1.
Figure 3:
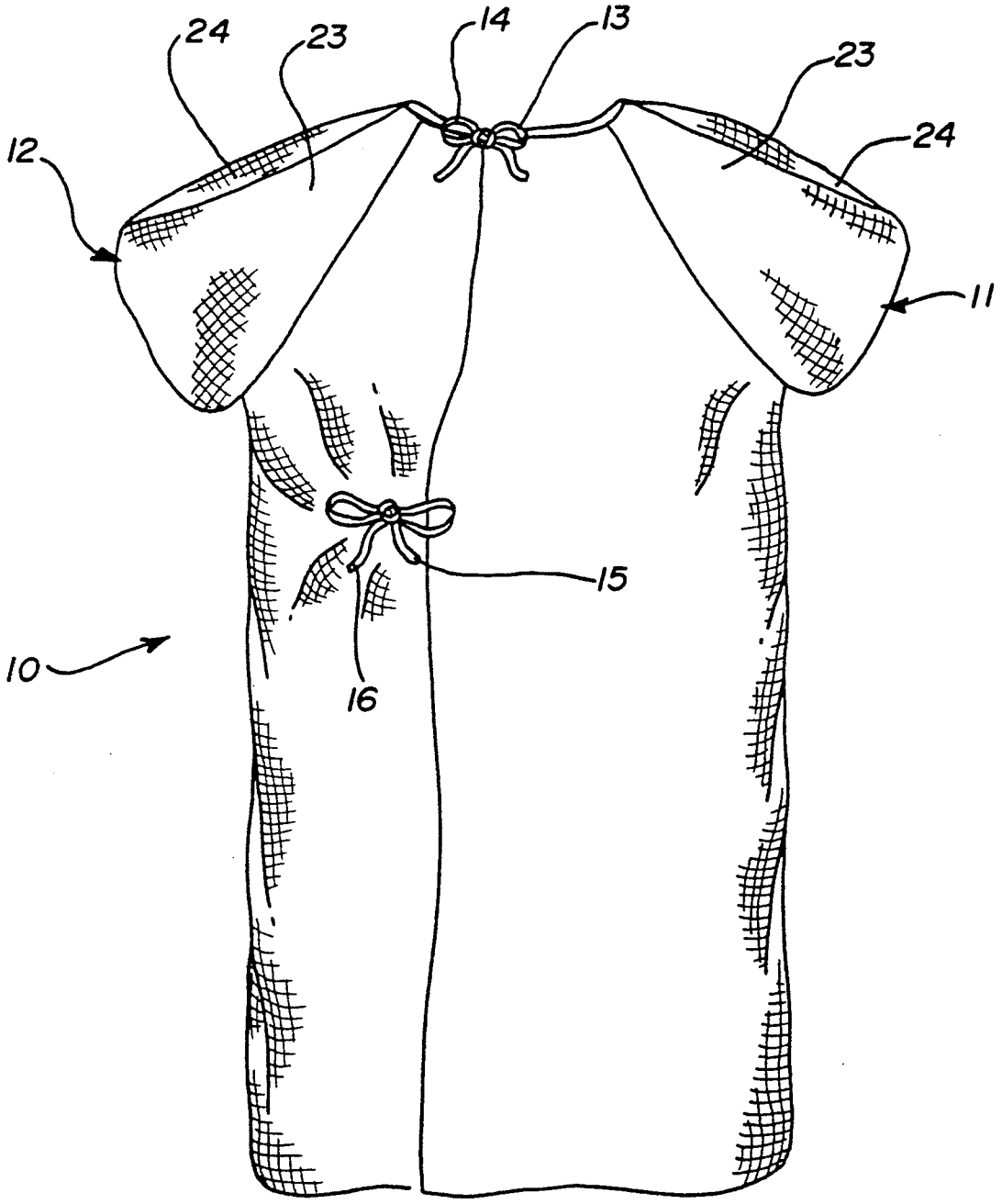
FIG. 3 is a rear elevational view of the gown as shown in FIG. 1.
Figure 4:
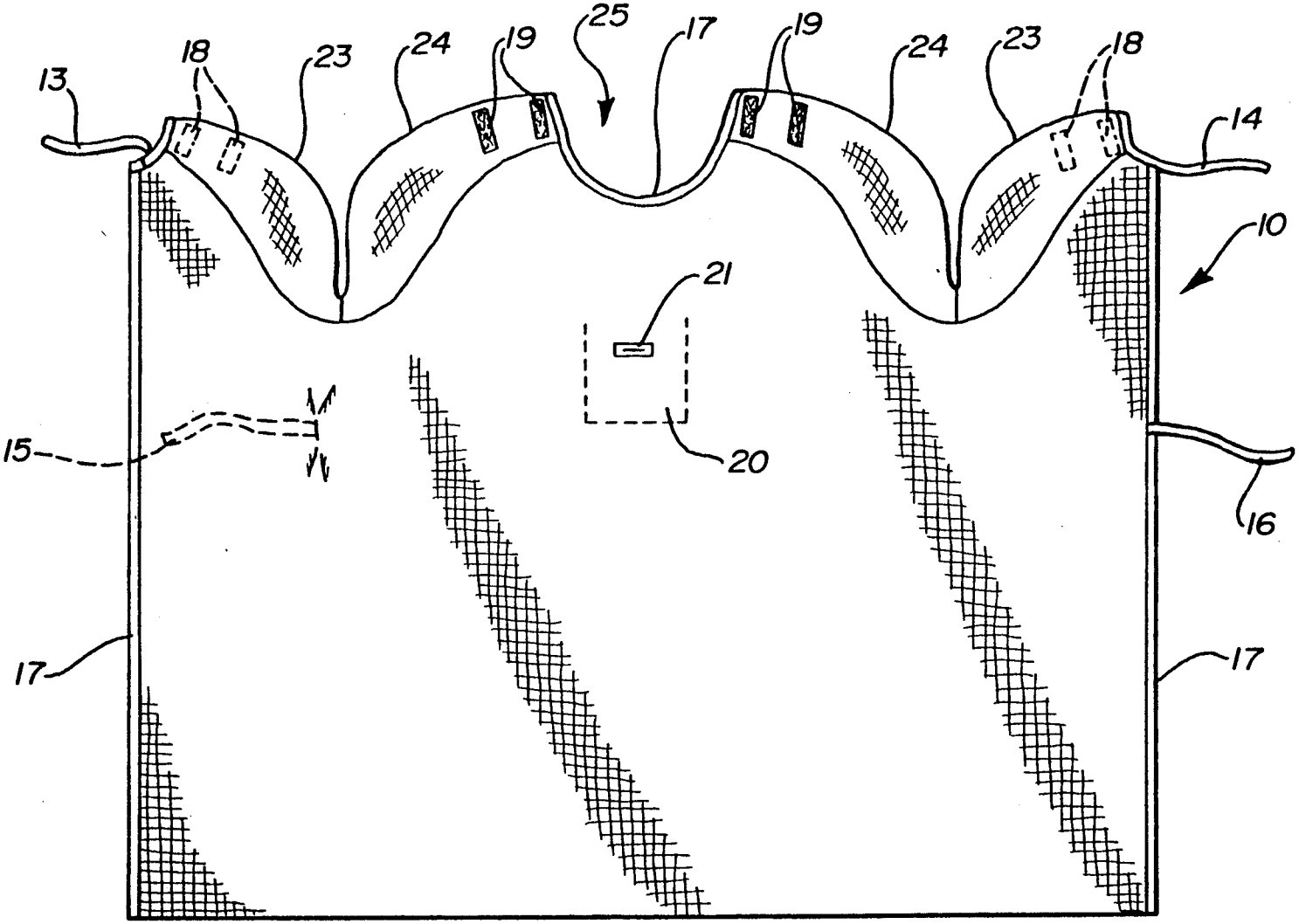
FIG. 4 is a rear elevational view of the gown in the unfastened position.

Referring to the accompanying drawings, FIGS. 1–6, the gown 10 is basically one-piece as shown in FIG. 4, that can be fully opened to expose all surfaces for cleaning. The gown can be made from either one large bolt 47 inches wide which becomes the length of the gown or it can be made from three panels. It does not require ironing, has two butterfly sleeves 11 and 12, and can be easily repaired with an adhesive fabric patch in case there are any rips to various parts of the gown. The cotton ties 13 and 14, at the neck, and cotton ties 15 and 16, at the waist, can easily be replaced without jeopardizing the integrity of the gown. All of the surfaces of the gown are welted or bound to avoid irritation to the skin of a patient. All the seams 17 are safety-surged so as not to chafe the patient's skin.

Figure 5:
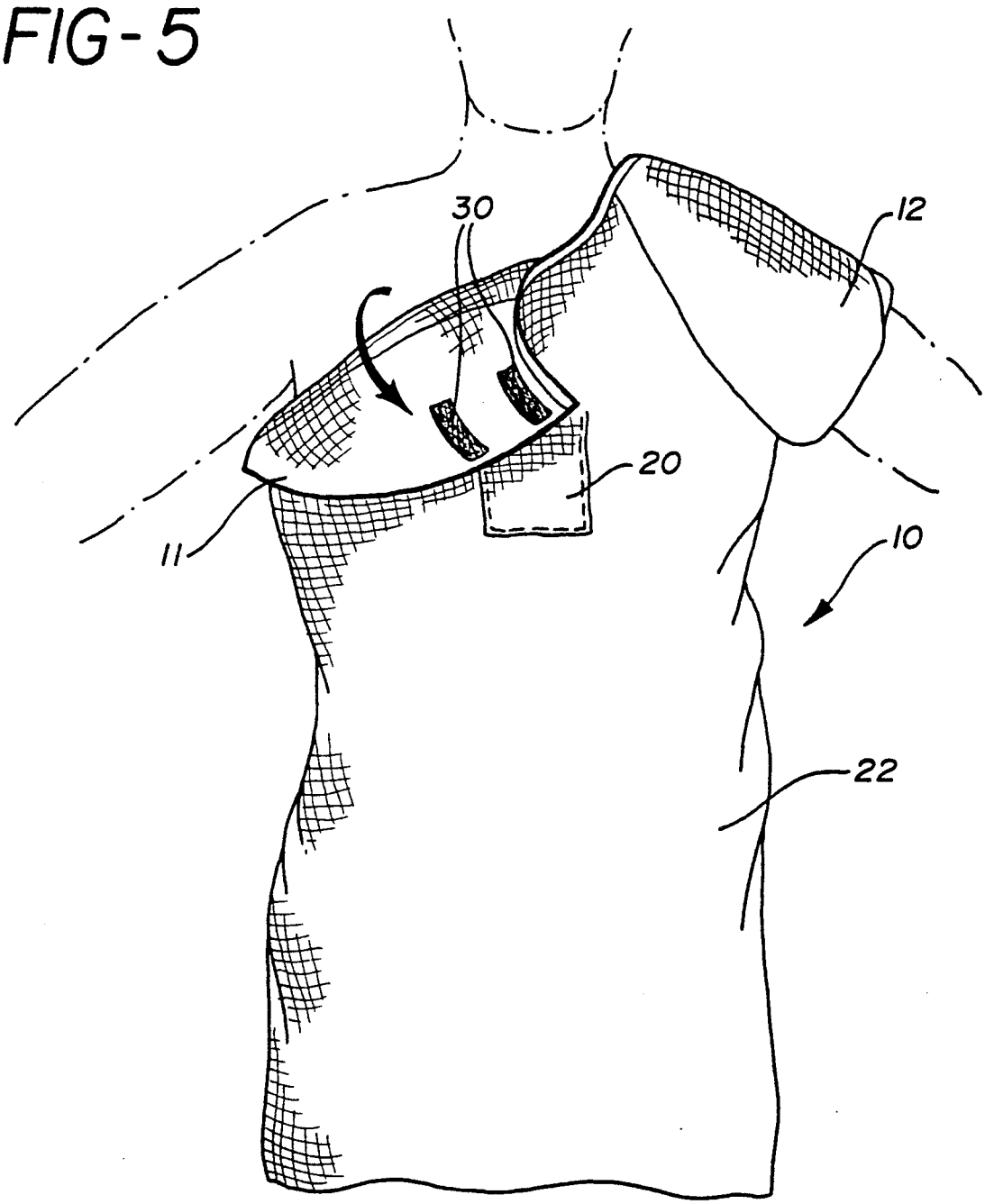
FIG. 5 is a front elevational view of the gown on a patient with one open butterfly sleeve.
Figure 6:
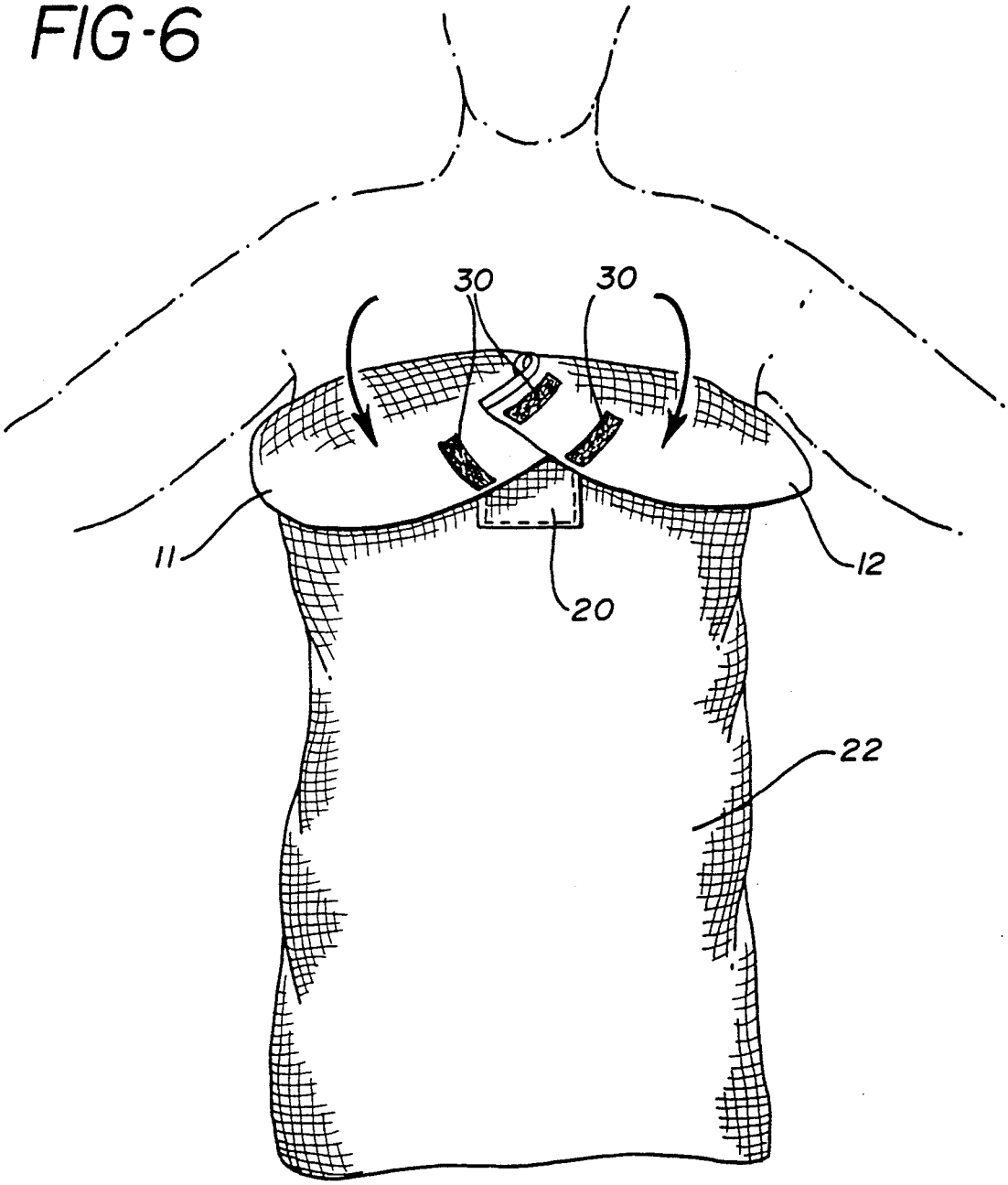
FIG. 6 is a front elevational view of the gown on a patient with both open butterfly sleeves.

The butterfly sleeves 11 and 12 are formed and provided with releasable VELCRO closure means by contacting the VELCRO mating hook and in pile strips 30 situated on the top open edges 23 and 24 of each butterfly sleeve 11 and 12, adjacent to the neck opening 25. The top edges 23 and 24 of the sleeve 11 and 12 are releasably connected with VELCRO closure means 30 so that the front panel 22, can be dropped partially on one side as shown in FIG. 5, or fully on both sides as shown in FIG. 6. This provides partial or complete access to the patient's chest area, while maintaining body coverage of the rest of the torso. Furthermore, because there are two VELCRO closure means 30 for each sleeve, the gown can be adjusted in its fore and aft dimension, and also its width dimension to the neck closure, and adjusted for the diameter of the arm opening of the sleeve. The adjustable butterfly sleeves fit the patient's size.

The flexibility of the VELCRO closure at the top of the gown allows for easy placement of arterial lines into the major veins without having to open the gown or disturb the patient unduly as would normally be the case with a back opening gown. The ability to bring down the back of the gown allows for easy access for purposes of chest examination, etc. The entire gown provides an enhanced modesty for the patient while allowing access to various portions of the patient by the doctor with minimum manipulation and without unnecessary complications to the patient. Each of the arms can be independently opened to administer I.V. (intravenous) connections to the patient and/or for monitoring of blood pressure.

The versatile gown is additionally provided with a pocket 20, on the front of the gown 10, that is used to capture telemetry devices for invasive monitoring of the patient so that no external supports are necessary, such as taping them to an arm or binding them with bands around the chest. Therefore, the chance of interfering with the operation of the invasive monitoring instrumentation is substantially reduced, and the comfort of the patient is enhanced. Front pocket 20, is offset to the right side to stay away from the median line of the chest where the sternum is located, in case the patient has had open-heart surgery or any other heart procedure. The telemetry pocket 20 will not rest on, or irritate the scar/wound. Inside the front pocket 20 is a buttonhole 21, to pass the lead from the telemeter unit into an invasive line within the body.

The construction of the gown 10 allows each half of the front panel 22, to be opened independently as shown in FIG. 5, for purposes of access to each half of the front torso which is useful for infant care and/or mammography testing. The entire front can be brought down to gain access to the chest, as shown in FIG. 6, and to the invasive lines that are used in the patient.

The versatile gown is also very good for orthopedics, because the gown can be put around the arms without having to move the arms, such as use with casts; and it is also adjustable to handle the various sizes due to the two VELCRO closures 30, on the top edges 23 and 24, of each butterfly sleeve. The VELCRO closures 30, may be provided with color fast tabs underneath the four VELCRO closures, so that it makes it easier to assemble the gown, e.g., red to red, green to green, etc.

Having thus described the present invention in detail, it is to be understood that the foregoing description is not intended to limit the spirit and scope thereof. What is desired to be protected by this letters patent is set forth in the appended claims.

I claim:

1. A patient gown for providing access to the patient's torso without necessitating removal of the gown comprising:

a front panel having a neck portion formed therein for covering the front of the patient;

two back panels, each of said back panels being formed adjacent to said front panel on the patient;

first fastening means attached to said back panels for opening and closing said back panels;

two openable sleeves each formed of a first part attached to said front and a second part attached to respective ones of said back panels and having top edges;

said first and second parts each having curvilinear end portions at their respective top edges for substantially the entire length of said end portions;

second fastening means attached to said first and second parts in proximity to said curvilinear end portions for opening and closing said first and second parts;

pocket means formed on said front panel for holding patient monitoring equipment herein and an aperture in said front panel formed adjacent to said pocket means for permitting passage of medical apparatus therethrough.

2. The gown of claim 1 wherein said front panel and said back panels are formed as a single sheet of material.

3. The gown of claim 1 wherein said front panel and said back panels are formed of three separate sheets of material.

4. The gown of claim 1 wherein said pocket means is formed at a location on said front panel so as to avoid proximity to the patient's sternum.

5. The gown of claim 1 wherein said first and second fastening means are color coded.

6. The gown of claim 1 wherein said back panels are formed so that they may be open and closed to avoid exposure of the patient's buttock.

7. A patient gown for providing access to various portions of a patient's torso without necessitating removal of the entire gown comprising:

a front panel having a neck portion formed therein for covering the front of the patient, two back panels, each of said back panels being formed adjacent to said front panel on opposite sides of said neck portion for covering the back of the patient;

first fastening means attached to said back panels for opening and closing said back panels to avoid exposure of the patient's buttock;

two operable sleeves each formed of a first part attached to said front panel adjacent to and on opposite sides of said neck portion and a second part attached to respective ones of said back panels and having top edges;

said first and second parts each having curvilinear end portions at their respective top edges for substantially the entire length of said end portions;

each of said first parts extending from said front panel at a location to expose the patient's breast;

second fastening means attached to said first and second parts for opening and closing said first and second parts;

pocket means formed on said front panel for holding patient monitoring equipment therein and an aperture in said front panel formed in said pocket means for permitting passage of medical apparatus therethrough.

8. A patient gown for providing access to various portions of a patient's torso without necessitating removal of the entire gown comprising:

front panel means for covering the front of the patient, said front panel means having a portion formed therein for surrounding the patient's neck;

back panel means formed adjacent to said front panel means for covering the back of the patient, first fastening means attached to said back panel means for enabling said back panel means to be opened and closed to avoid exposure of the patient's buttock;

opening sleeve means each formed of a first part attached to said front panel means adjacent to and on opposite sides of said neck portion and a second part attached to respective ones of said back panels and having top edges;

said first and second parts each having curvilinear end portions at their respective top edges for substantially the entire length of said end portions;

each of said first parts extending from said front panel means at a location so as to expose each of the patient's breasts; and second fastening means attached to said first and second parts of each of said sleeve means.

* * * * *